US005812063A

United States Patent [19]

Weng et al.

[11] Patent Number: 5,812,063

[45] Date of Patent: Sep. 22, 1998

[54] LIGHTING CIRCUIT ASSEMBLY FOR SHOES

[76] Inventors: Ming-Bi Weng, 6F, No. 22, Alley 10, Lane 75, Min-Yu St., Yungho City, Taipei Hsien; Ming-Ta Chang, No. 68, Alley 52, Lane 39, Lien-Tsun Rd., Feng Yuan City, Taichung Hsien, both of Taiwan

[21] Appl. No.: 831,425

[22] Filed: Apr. 1, 1997

[51] Int. Cl.[6] ..... G08B 5/22

[52] U.S. Cl. ..... 340/815.45; 36/137; 340/815.42; 362/103

[58] Field of Search ..... 340/815.4, 815.45, 340/815.42, 573; 362/103, 32; 36/137

[56] References Cited

U.S. PATENT DOCUMENTS

| | | | |
|---|---|---|---|
| 5,052,131 | 10/1991 | Rondini | 362/103 |
| 5,546,681 | 8/1996 | Goldstein et al. | 362/103 |
| 5,588,734 | 12/1996 | Talamo et al. | 362/103 |
| 5,599,088 | 2/1997 | Chien | 362/103 |
| 5,663,614 | 9/1997 | Weng et al. | 362/103 |
| 5,664,346 | 9/1997 | Barker | 36/137 |

FOREIGN PATENT DOCUMENTS

| | | | |
|---|---|---|---|
| 9415494 | 7/1994 | WIPO | 36/137 |

*Primary Examiner*—Brent A. Swarthout
*Attorney, Agent, or Firm*—Morton J. Rosenberg; David I. Klein; Jub Y. Lee

[57] ABSTRACT

A lighting circuit assembly mounted in a shoe and controlled to produce a lighting effect, including a switch, a control unit, an oscillation resistor for flash frequency control, a plurality of LEDs controlled to flash by the control unit, and a plastic member of a particular design coated with a layer of light conductive material and attached to two LEDs to receive and refract light, the control unit having a selection circuit for selecting flash modes of the LEDs.

11 Claims, 6 Drawing Sheets

LIGHTING CIRCUIT ASSEMBLY FOR SHOES

BACKGROUND OF THE INVENTION

The present invention relates to a lighting circuit assembly for shoes, and more particularly to such a lighting circuit assembly which comprises a hollow plastic member of a particular design coated with a layer of light conductive material and attached to two LEDs thereof to receive and refract light.

FIG. 1 shows a lighting circuit assembly for shoes according to the prior art. This lighting circuit assembly comprises a switch 2', a control unit 3' controlled by the switch 2' to drive a plurality of LEDs (light emitting diodes) 5', causing them to flash, and an oscillation resistor 4' adapted for regulating the flashing speed of the LEDs 5'. The control unit 3' is triggered by a triggering signal from the switch 2' to drive the LEDs 5', causing the LEDs 5' to flash at one of four flashing modes. The flashing frequency of the LEDs 5' is controlled at one per every 1 to 5 seconds.

SUMMARY OF THE INVENTION

The present invention provides a lighting circuit assembly mounted in a shoe and controlled to produce a lighting effect, including a switch, a control unit, an oscillation resistor for flash frequency control, a plurality of LEDs controlled to flash by the control unit, and a plastic member of a particular design coated with layer of light conductive material and attached to two LEDs to receive and refract light, the control unit having a selection circuit for selecting flash modes of the LEDs. When light passes through the hollow plastic member, a fantastic lighting effect is produced.

DETAILED DESCRIPTION OF THE PREFERRED EMBODIMENT

Figure 1:
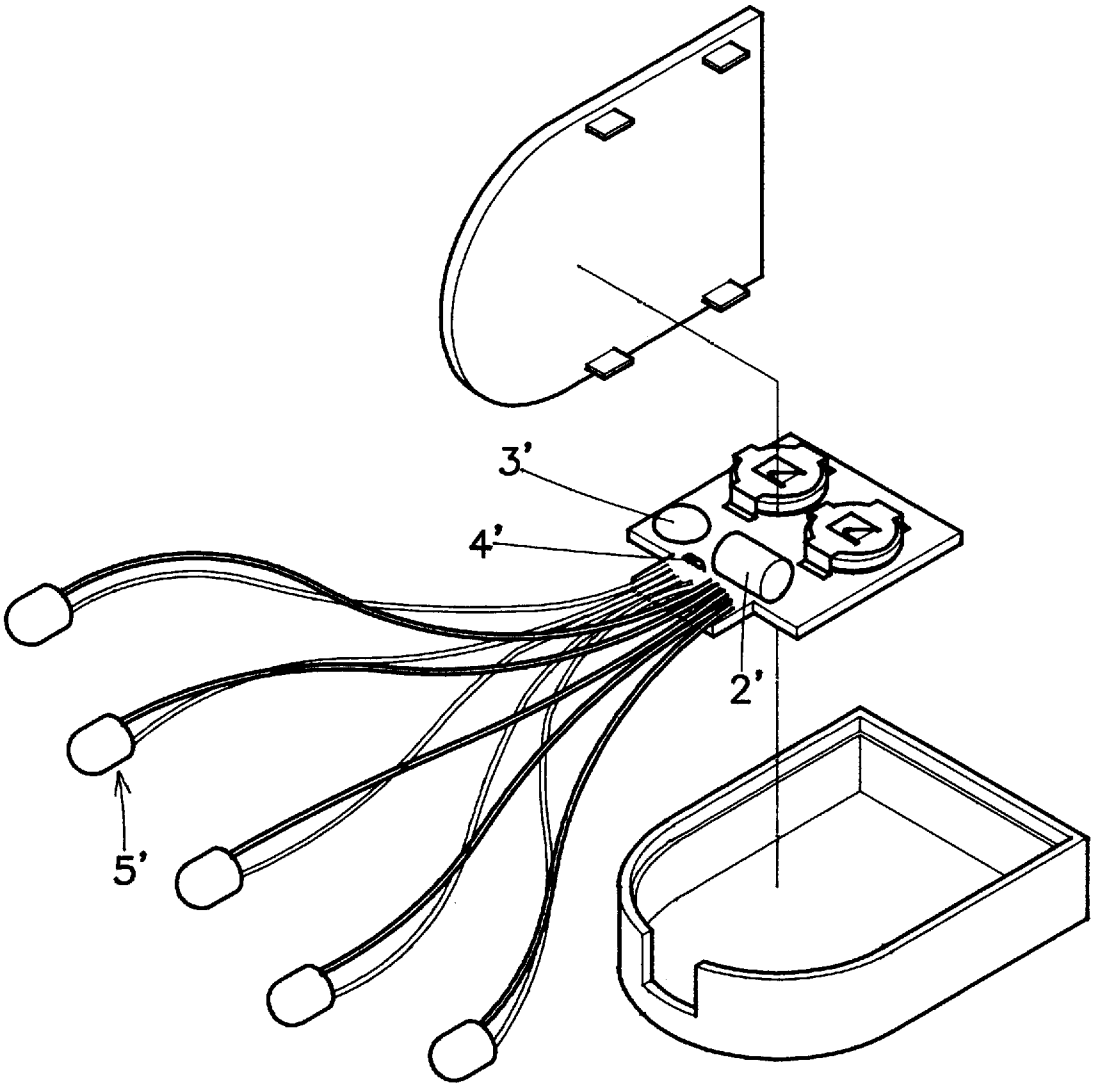
FIG. 1 PRIOR ART
FIG. 1 is a lighting circuit assembly for shoes according to the prior art.
Figure 2:
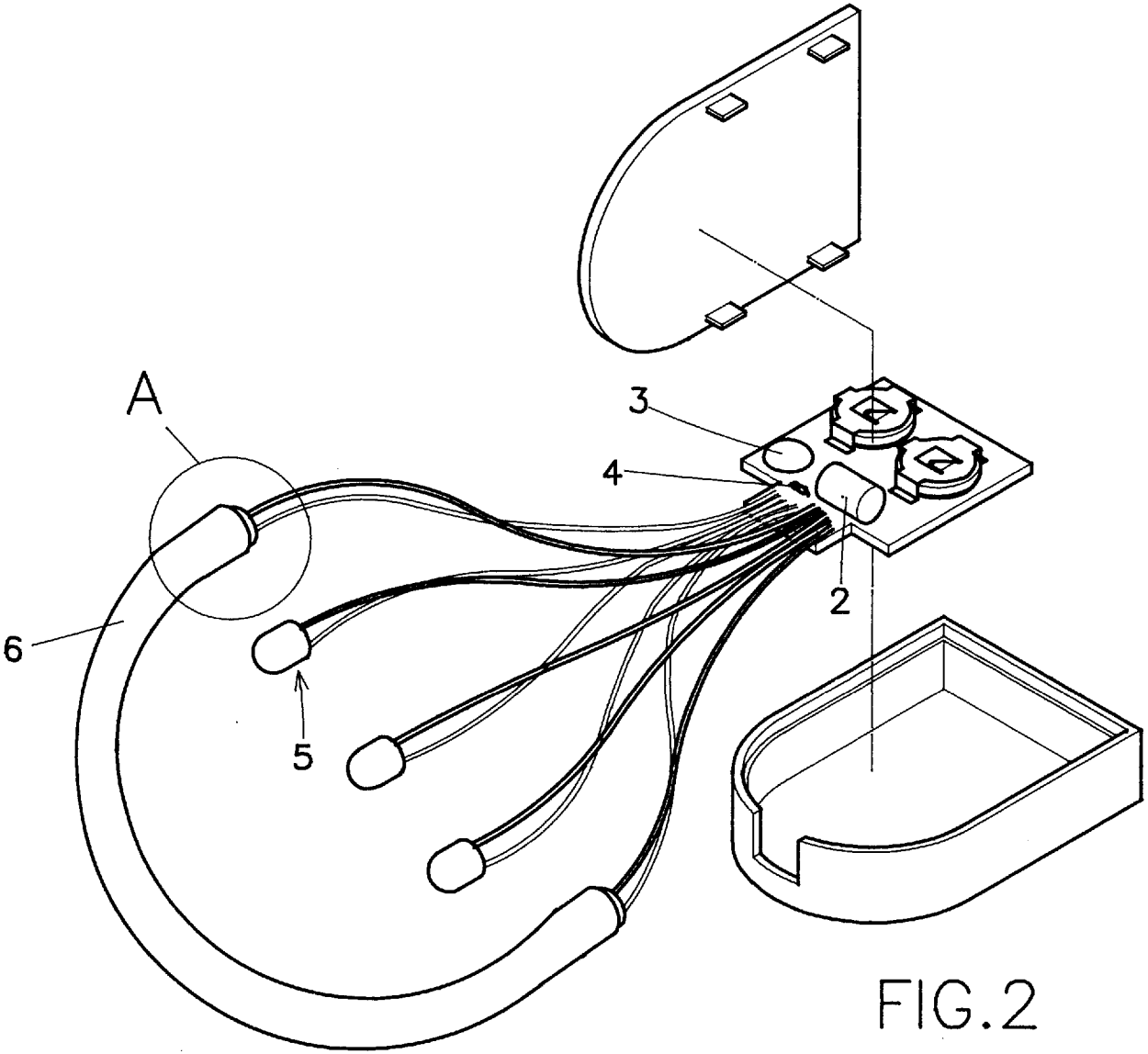
FIG. 2 is a lighting circuit assembly for shoes according to the present invention.
Figure 2A:
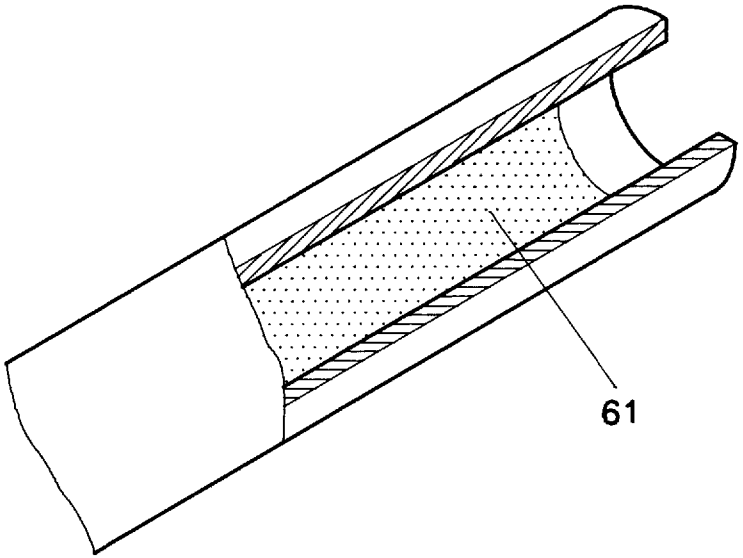
FIG. 2A is a cutaway of a plastic member according to the present invention.
Figure 3:
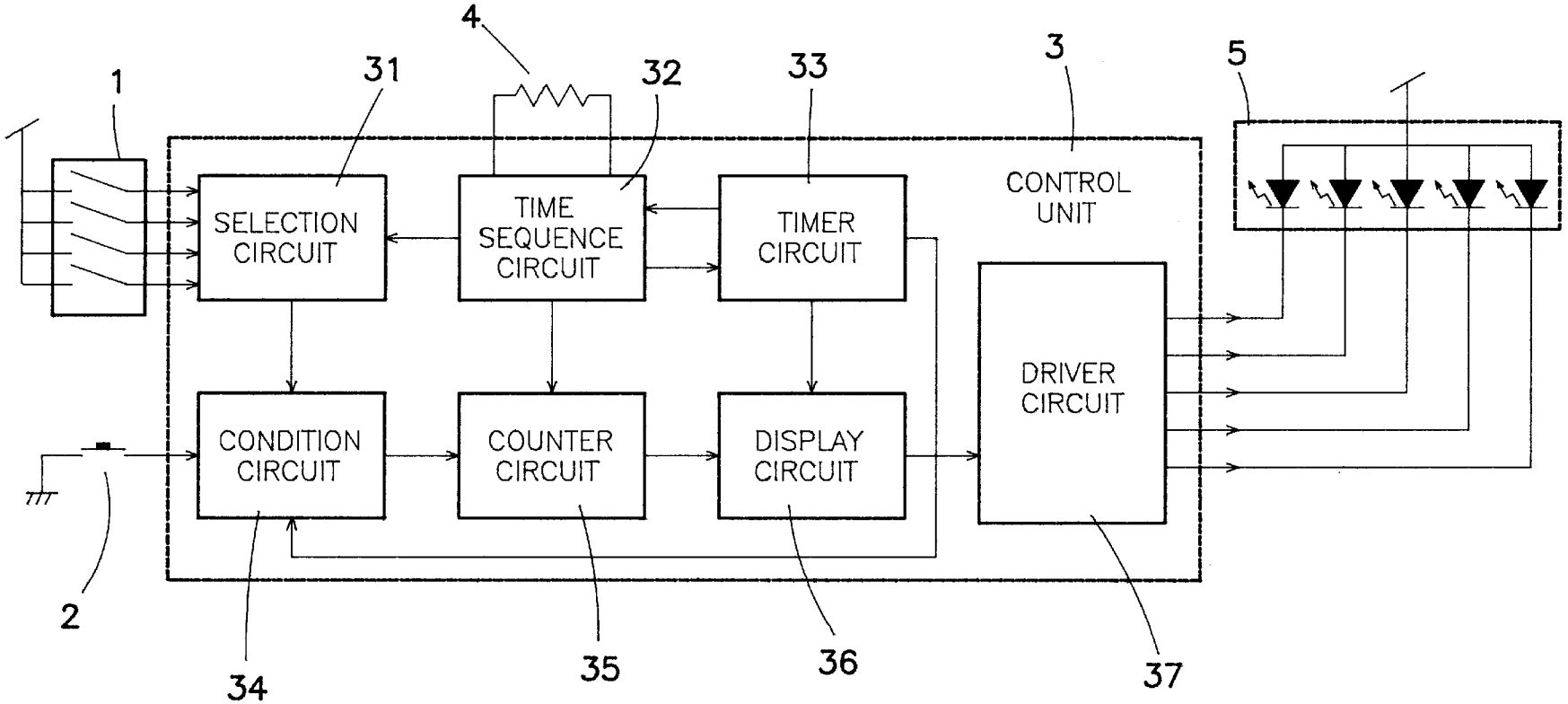
FIG. 3 is a circuit block diagram of the control unit according to the present invention.

Referring to FIGS. 2 and 3, a lighting circuit assembly in accordance with the present invention is generally comprised of a switch 2, a control unit 3, an oscillation resistor 4, a plurality of LEDs (light emitting diodes) 5, and a plastic member 6. The LEDs 5 are respectively connected to the output end of the control unit 3. The plastic member 6 is covered on to for example two of the LEDs 5, having an inside wall coated with a layer of light conductive material 61 (see FIG. 2). By means of the control of the control unit 3, the LEDs 5 are driven to flash, and light from the respective LEDs 5 is transmitted through the plastic member 6, thereby causing a lighting effect to be produced. Further, the plastic member 6 can be arranged to show a pattern, words, etc.

Referring to FIG. 3 again, the control unit 3 comprises a selection circuit 31, a time sequence circuit 32, a timer circuit 33, a condition circuit 34, a counter circuit 35, a display circuit 36, and a driver circuit 37. The timer circuit 33 has an output end connected to an input end of the condition circuit 34 and an input end of the display circuit 36, and an input/output end connected to the time sequence circuit 32. The aforesaid oscillation resistor 4 is connected to the time sequence circuit 32. The time sequence circuit 32 has an output end connected to an input end of the selection circuit 31 and an input end of the counter circuit 35. The selection circuit 31 has an input end connected to a flash control 1, and an output end connected to the condition circuit 34. The condition circuit 34 has an input end connected to the switch 2, and an output end connected to an input end of the counter circuit 35. The counter circuit 35 has an output end connected to an input end of the display circuit 36. The display circuit 36 has an output end connected to an input end of the driver circuit 37. The driver circuit 37 has an output end connected to the LEDs 5. The time sequence circuit 32 is controlled to provide a time pulse signal. The oscillation resistor 4 can be controlled to regulate the frequency of the time pulse signal of the time sequence circuit 32, so as to regulate the flashing speed of the LEDs 5. The timer circuit 33 receives the time pulse signal of the time sequence circuit 32, and drives the control unit 3 to output an executive mode control signal or stop mode control signal. The selection circuit 31 is controlled by one of the four contacts of the flash control 1 to select one of four flash modes, and to provide an output signal to the condition circuit 34 subject to the time pulse signal received from the time sequence circuit 32. The four flash modes include:

Mode 1

The LEDs are controlled to flash from the middle toward both sides.

Mode 2

The LEDs are controlled to flash synchronously.

Mode 3

The LEDs are controlled to flash from the left to the right and then from the right to the left.

Mode 4

The LEDs of odd number and the LEDs of even number are controlled to flash alternatively.

Figure 4:
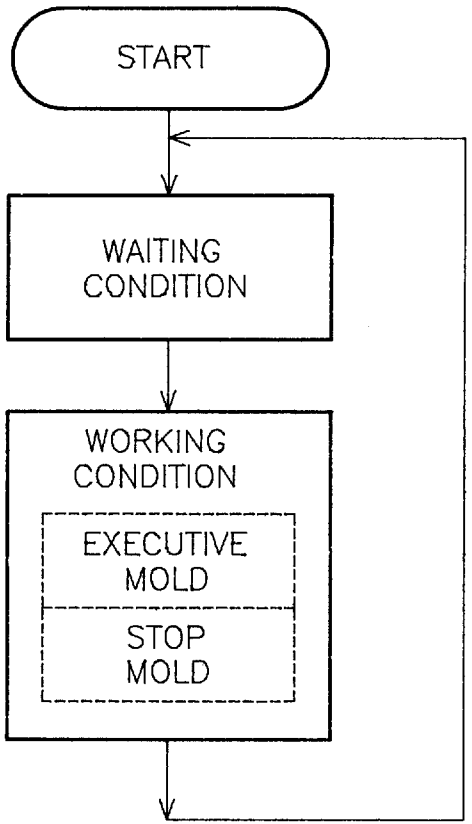
FIG. 4 is an operation flow chart of the control unit according to the present invention.

The condition circuit 34 provides waiting/working conditions. The operation flow chart of the condition circuit 34 is shown in FIG. 4. When started, the condition circuit 34 is at the waiting condition. When a triggering signal is received by the condition circuit 34 from the switch 2, the condition circuit 34 is immediately turned to the working condition to match with the executive mold/stop mode of the timer circuit 33. When at the executive mode, the counter circuit 35 receives the output signal of the condition circuit 34 and the output signal of the time sequence circuit 32, and is controlled by the received signals to count up/down and to send the counting result to the display circuit 36, causing the display circuit 36 to provide a flash signal to the LEDs 35 through the driver circuit 37. This flash signal is repeated 2 to 5 times, and then the timer circuit 33 enters the stop mode. When the timer circuit 33 enters the stop mode, it stops the display circuit 36 from giving an output signal to the driver circuit 37, and then the condition circuit 31 returns to the waiting condition 1 to 5 seconds after the LEDs 5 are off. When at the working condition, the condition circuit 34 does not accept the triggering signal of the switch 2.

Figure 5:
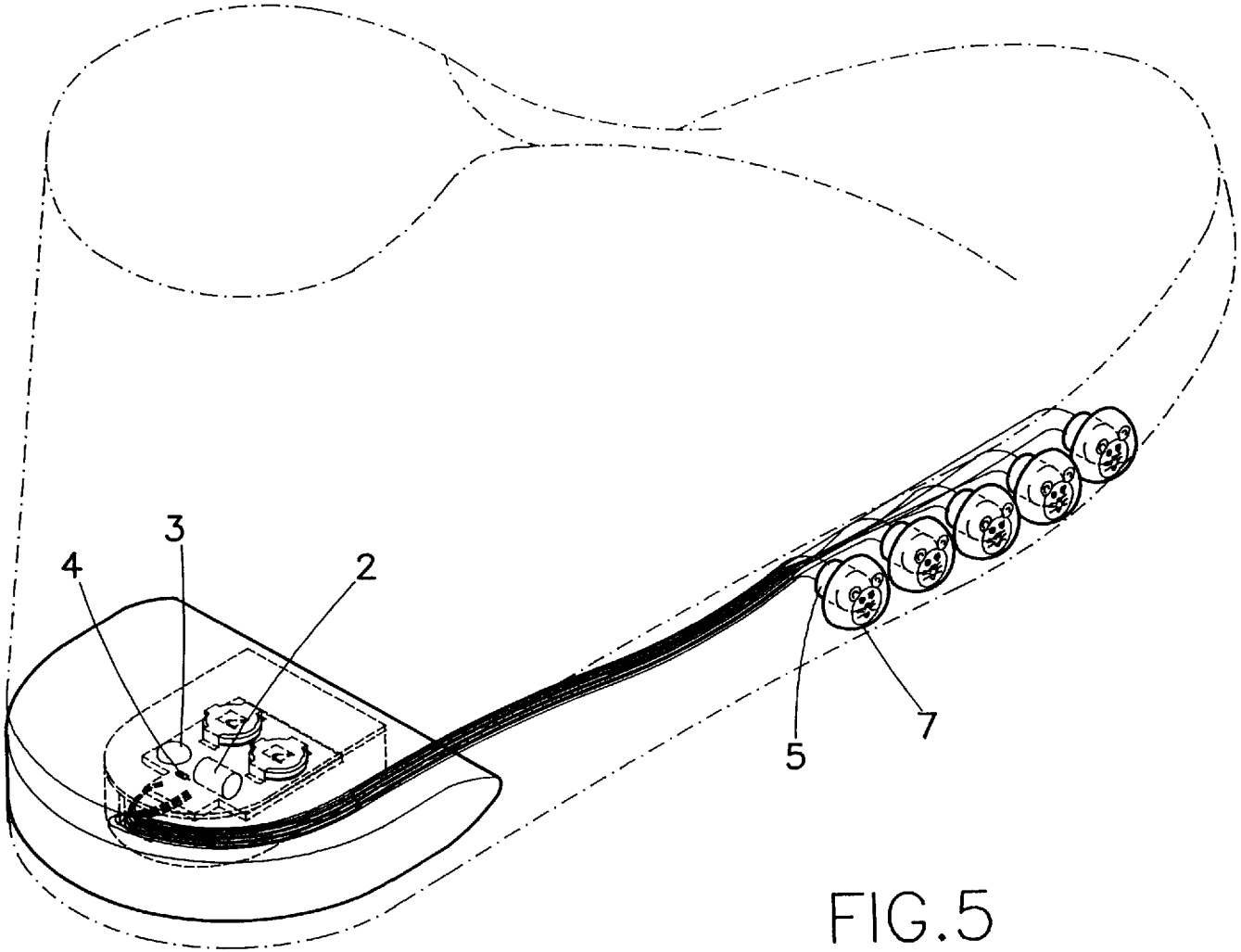
FIG. 5 is an applied view of the present invention, showing the lighting circuit assembly installed in a shoe.

Referring to FIG. 5, a shade 7 may be respectively covered on each LED 5. The shade 7 can have any of a variety of shapes.

It is to be understood that the drawings are designed for purposes of illustration only, and are not intended as a definition of the limits and scope of the invention disclosed.

What the invention claimed is:

1. A lighting circuit assembly comprising a plurality of light emitting elements, a control unit controlled to drive said light emitting elements to flash, and a hollow plastic member internally coated with a layer of light conductive material and connected to a number of said light emitting elements to transmit light therefrom, said control unit comprising a selection circuit, a time sequence circuit, a timer circuit, a condition circuit, a counter circuit, a display circuit and a driver circuit, a switch connected to said condition circuit for controlling its condition, and an oscillation resistor connected to said time sequence circuit, said timer circuit having an output end connected to an input end of said condition circuit and an input end of said display circuit, and an input/output end connected to said time sequence circuit, said time sequence circuit having an output end connected to an input end of said selection circuit and an input end of said counter circuit, said selection circuit having an output end connected to said condition circuit, said condition circuit having an input end connected to said switch and an output end connected to an input end of said counter circuit, said counter circuit having an output end connected to an input end of said display circuit, said display circuit having an output end connected to an input end of said driver circuit, said driver circuit having an output end connected to said light emitting elements, said time sequence circuit being controlled by said oscillation resistor to provide a time pulse signal to said timer circuit said selection circuit and said counter circuit, said timer circuit being driven by said time sequence circuit to output an executive mode/stop mode control signal, said selection circuit being controlled to select one of a plurality of predetermined flash modes and to provide a corresponding output signal to said condition circuit subject to the time pulse signal received from said time sequence circuit, said condition circuit being controlled by said switch to provide waiting/working conditions, said timer circuit being turned to the executive mode when said condition circuit receives a triggering signal from said switch and is turned to said working condition, said counter circuit receiving the output signal of said condition circuit and the output signal of said time sequence circuit when at the executive mode, and controlled by the received signals to count up/down and to send the counting result to said display circuit, causing said display circuit to provide a flash signal to said light emitting elements through said driver circuit.

2. The lighting circuit assembly of claim 1 wherein said hollow plastic member is arranged to show a design.

3. The lighting circuit assembly of claim 1 wherein said light emitting elements are light emitting diodes.

4. The lighting circuit assembly of claim 1 wherein said condition circuit does not accept the triggering signal from said switch when it is at the working condition.

5. The lighting circuit assembly of claim 1 wherein the flash signal from said display circuit is repeated 2 to 5 times, and then said timer circuit enters the stop mode for 1 to 5 seconds.

6. The lighting circuit assembly of claim 1 wherein said light emitting elements are respectively covered with a respective shade.

7. The lighting circuit assembly of claim 1 wherein said selection circuit provides at least four flash modes.

8. The lighting circuit assembly of claim 7 wherein said light emitting elements are controlled to flash from the middle toward both sides.

9. The lighting circuit assembly of claim 7 wherein said light emitting elements are controlled to flash synchronously.

10. The lighting circuit assembly of claim 7 wherein said light emitting elements are controlled to flash from the left to the right and then from the right to the left.

11. The lighting circuit assembly of claim 7 wherein said light emitting elements are arranged into an odd number group and an even number group, the light emitting elements of odd number group and the light emitting elements of even number group being controlled to flash alternatively.

* * * * *